US011422488B2

(12) United States Patent
Ikeura

(10) Patent No.: US 11,422,488 B2
(45) Date of Patent: Aug. 23, 2022

(54) IMAGING SYSTEM INCLUDING A BIAS APPLICATION DEVICE TO APPLY BIAS TO A TRANFER ROLLER

(71) Applicant: HEWLETT-PACKARD DEVELOPMENT COMPANY, L.P., Spring, TX (US)

(72) Inventor: Shun Ikeura, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/279,891

(22) PCT Filed: Oct. 1, 2019

(86) PCT No.: PCT/US2019/053994
§ 371 (c)(1),
(2) Date: Mar. 25, 2021

(87) PCT Pub. No.: WO2020/081225
PCT Pub. Date: Apr. 23, 2020

(65) Prior Publication Data

US 2022/0035276 A1 Feb. 3, 2022

(30) Foreign Application Priority Data

Oct. 17, 2018 (JP) ..... JP2018-195673

(51) Int. Cl.
*G03G 15/16* (2006.01)
*G03G 15/00* (2006.01)

(52) U.S. Cl.
CPC ..... *G03G 15/1675* (2013.01); *G03G 15/5054* (2013.01)

(58) Field of Classification Search
USPC ..... 399/66
See application file for complete search history.

(56) References Cited

U.S. PATENT DOCUMENTS 5,438,398 A 8/1995 Tanigawa et al.
9,285,722 B2 3/2016 Tanaka et al.
(Continued)

FOREIGN PATENT DOCUMENTS

CN 102231052 11/2011
JP 2012-14054 1/2012
(Continued)

OTHER PUBLICATIONS

Extended European Search Report, dated May 10, 2022, in European Patent Application No. 19874555.6 (8 pp.).

*Primary Examiner* — Quana Grainger
(74) *Attorney, Agent, or Firm* — Staas & Halsey LLP

(57) ABSTRACT

An imaging system includes a transfer roller, a bias application device, and a controller. The transfer roller forms a transfer nip region between the transfer roller and a transfer belt, and the transfer roller transfers toner images carried on the transfer belt, onto media conveyed through the transfer nip region, during a print job. The bias application device applies a bias to the transfer roller. The controller controls the bias application device to apply a first bias to the transfer roller so that the toner image is transferred to a first medium during the printing job, apply a second bias having a polarity opposite to the first bias to the transfer roller between the first medium and a second medium following the first medium, and apply a third bias having the same polarity as the first bias to the transfer roller between the first medium and the second medium.

15 Claims, 13 Drawing Sheets

(56) References Cited

U.S. PATENT DOCUMENTS

| | | | | |
|---|---|---|---|---|
| 2009/0232539 | A1 | 9/2009 | Nozawa et al. | |
| 2014/0023388 | A1* | 1/2014 | Yoshida ..... | G03G 15/1665 399/66 |
| 2016/0187815 | A1 | 6/2016 | Funatani et al. | |

FOREIGN PATENT DOCUMENTS

| | | |
|---|---|---|
| JP | 2012-18369 | 1/2012 |
| JP | 2012-198497 | 10/2012 |
| JP | 2012-237916 | 12/2012 |
| JP | 2014-62981 | 4/2014 |
| JP | 2016-102916 | 6/2016 |
| JP | 2017-134273 | 8/2017 |

* cited by examiner

*Fig.9*

| SHEET TYPE | 30° 85%RH | 22°C 55%RH | 10°C 10%RH |
|---|---|---|---|
| PLAIN SHEET (80g/m$^2$) | 0.3 | 0.2 | 0.15 |
| DOUBLE COATED SHEET (80g/m$^2$) | 0.6 | 0.4 | 0.3 |

*Fig.11*

| SHEET TYPE | 30° 85%RH | 22°C 55%RH | 10°C 10%RH |
|---|---|---|---|
| PLAIN SHEET (80g/m$^2$) | 0.004 | 0.003 | 0.002 |
| DOUBLE COATED SHEET (80g/m$^2$) | 0.008 | 0.005 | 0.003 |

*Fig.12*

| SHEET TYPE | 30° 85%RH | 22℃ 55%RH | 10℃ 10%RH |
|---|---|---|---|
| PLAIN SHEET (80g/m$^2$) | 0.002 | 0.002 | 0.002 |
| DOUBLE COATED SHEET (80g/m$^2$) | 0.004 | 0.004 | 0.003 |

IMAGING SYSTEM INCLUDING A BIAS APPLICATION DEVICE TO APPLY BIAS TO A TRANFER ROLLER

CROSS REFERENCE TO RELATED APPLICATIONS

This application is a U.S. National Stage Application which claims the benefit under 35 U.S.C. § 371 of International Patent Application No. PCT/US2019/053994 filed on Oct. 1, 2019, which claims priority to Japanese Patent Application No. 2018-195673 filed on Oct. 17, 2018, the contents of each of which are incorporated herein by reference.

BACKGROUND

An imaging device uniformly charges a surface of an image carrier, forms an electrostatic latent image by exposing the surface, and develops the electrostatic latent image by toner so that a toner image is formed on the surface of the image carrier.

BRIEF DESCRIPTION OF THE DRAWINGS

FIG. 9 is a table illustrating a sheet contamination measurement result of the bias control illustrated in FIG. 8.

FIG. 11 is a table illustrating a sheet contamination measurement result of the bias control illustrated in FIG. 10.

FIG. 12 is a table illustrating a sheet contamination measurement result of the bias control illustrated in FIG. 3.

DETAILED DESCRIPTION

In the following description, with reference to the drawings, the same reference numbers are assigned to the same components or to similar components having the same function, and overlapping description is omitted. An imaging system may be an imaging apparatus such as a printer or an image carrier polishing system mounted on the imaging apparatus.

Figure 1:
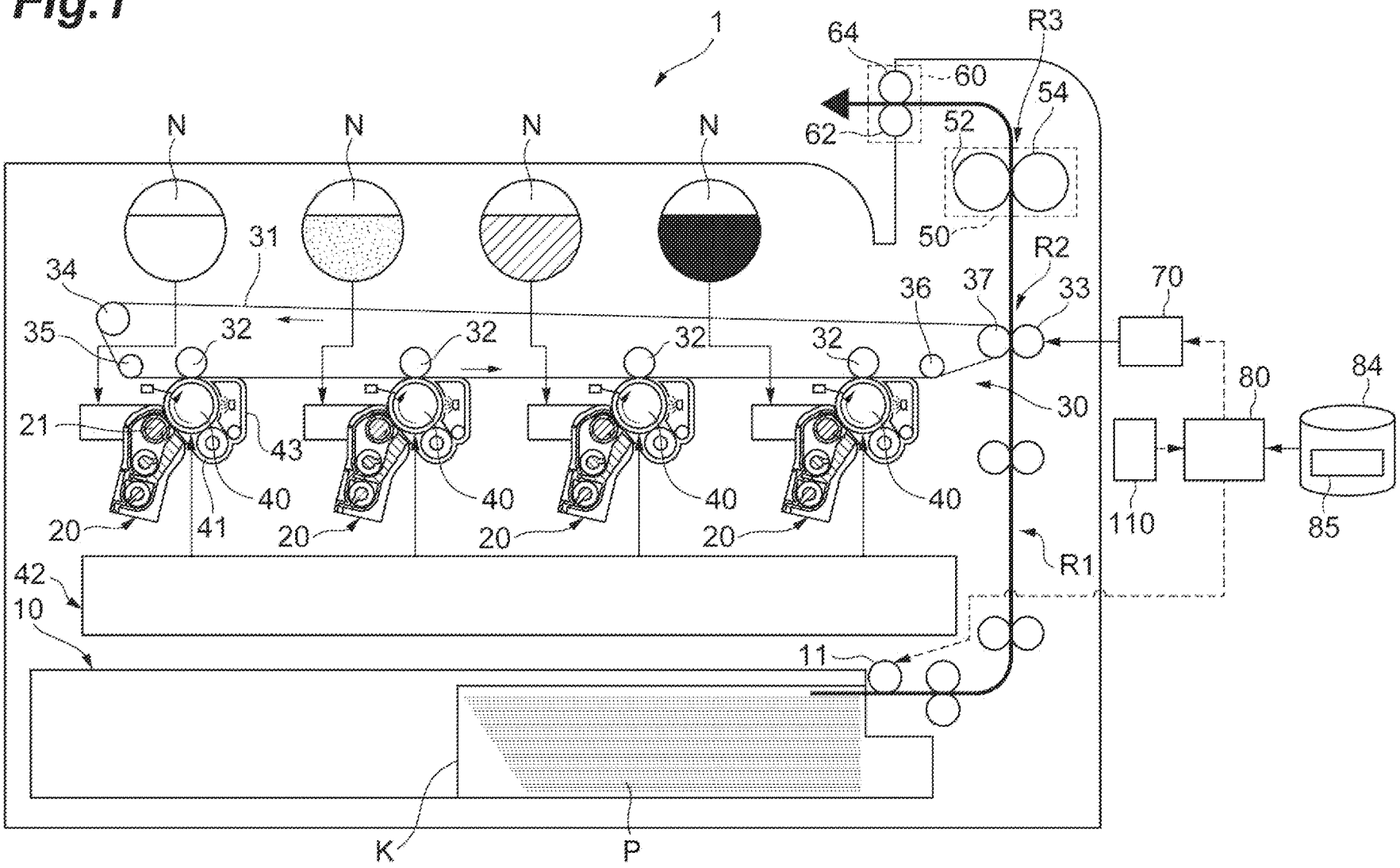
FIG. 1 is a schematic diagram illustrating an example imaging apparatus.

FIG. 1 is a diagram illustrating a schematic configuration of an example imaging apparatus 1. The imaging apparatus 1 illustrated in FIG. 1 may be configured to form a color image by using magenta, yellow, cyan, and black. The imaging apparatus 1 may include a conveying device 10 which conveys a sheet P corresponding to a recording medium, a developing device 20 which develops an electrostatic latent image, a transfer device 30 which secondarily transfers a toner image to the sheet P, an image carrier 40 in which an electrostatic latent image is formed on a surface (a peripheral surface), a fixing device 50 which fixes a toner image to the sheet P, and a discharging device 60 which discharges the sheet P.

The conveying device 10 may convey the sheet P corresponding to a recording medium having an image formed thereon along a conveying route R1. The sheet P is stacked and accommodated on, for example, a cassette K and is picked up and conveyed by a feeding roller 11. The conveying device 10 allows the sheet P to reach a transfer nip portion R2 through the conveying route R1, for example, at a timing in which the toner image transferred to the sheet P reaches the transfer nip portion R2 (the transfer nip region).

A separate developing device 20 may be provided for each color, for example, each of four colors. Each developing device 20 may include a developing agent carrier 21 which carries toner on the image carrier 40. In the developing device 20, a two-component developing agent including toner and carrier may be used as a developing agent. In some examples, in the developing device 20, the toner and the carrier are adjusted to a predetermined or particular mixing ratio and the toner and the carrier are mixed and stirred to uniformly disperse the toner. Accordingly, the developing agent is adjusted to have a predetermined or uniform charge amount. The developing agent is carried by the developing agent carrier 21. The developing agent carrier 21 rotates to carry the developing agent to a region facing the image carrier 40. Then, the toner in the developing agent carried on the developing agent carrier 21 moves to the electrostatic latent image formed on the peripheral surface of the image carrier 40 so that the electrostatic latent image is developed.

The sheet P may be conveyed to pass through the transfer nip portion R2 in which the transfer device 30 secondarily transfers the toner image formed by the developing device 20 to the sheet P. The transfer device 30 may include a transfer belt 31 (an image carrier) to which the toner image is initially transferred from the image carrier 40, suspension rollers 34, 35, 36, and 37 on which the transfer belt 31 are suspended, a primary transfer roller 32 which sandwiches the transfer belt 31 along with the image carrier 40, a secondary transfer roller 33 which sandwiches the transfer belt 31 along with the suspension roller 37, and a bias application unit, e.g., a bias application device 70.

The transfer belt 31 may include an endless belt which moves in a circulating manner by the suspension rollers 34, 35, 36, and 37. Each of the suspension rollers 34, 35, 36, and 37 may comprise a roller which is rotatable about each axis. The suspension roller 37 may comprise, for example, a driving roller which rotates about the axis. Each of the suspension rollers 34, 35, and 36 may comprise a driven roller which is rotated by the rotation of the suspension roller 37. In some examples, the primary transfer roller 32 is provided to press the image carrier 40 from the inner peripheral side of the transfer belt 31. The secondary transfer roller 33 may be disposed in parallel to (while facing) the suspension roller 37 with the transfer belt 31 interposed therebetween and to press the suspension roller 37 from the outer peripheral side of the transfer belt 31. The suspension roller 37 is disposed to face the secondary transfer roller 33 while pressing the secondary transfer roller 33 and sandwiches the transfer belt 31 along with the secondary transfer roller 33. Accordingly, the secondary transfer roller 33 forms the transfer nip portion R2 between the transfer belt 31 and the secondary transfer roller 33. The secondary transfer roller 33 transfers a toner image carried on the transfer belt 31 to the sheet P during a printing job. The bias application unit 70 applies a voltage (a bias) to the secondary transfer roller 33 in response to the control (which will be described later in further detail) of a controller 80.

The image carrier 40 may comprise an electrostatic latent image carrier, a photosensitive drum, or the like. A separate image carrier 40 may be provided for each color, for example, each of four colors. Each image carrier 40 may be provided along the movement direction of the transfer belt 31. In some examples, the developing device 20, a charging roller 41, an exposure unit, e.g., an exposure device 42, and a cleaning device 43 are provided on the periphery of the image carrier 40.

The charging roller 41 may comprise a charging member that uniformly charges the surface of the image carrier 40 to a predetermined potential. The charging roller 41 moves, for example, to follow the rotation of the image carrier 40. The exposure unit 42 may be configured to expose the surface of the image carrier 40 charged by the charging roller 41 in response to an image formed on the sheet P. Accordingly, a potential of a portion exposed by the exposure unit 42 in the surface of the image carrier 40 changes so that the electrostatic latent image is formed. In some examples, four developing devices 20 form the toner images by developing the electrostatic latent image formed on the image carriers 40 using the toner supplied from toner tanks N respectively facing the developing devices 20. The toner tanks N are respectively filled with, for example, magenta, yellow, cyan, and black toner. The cleaning device 43 may be configured to collect the toner remaining on the image carrier 40 after the toner image formed on the image carrier 40 is initially transferred to the transfer belt 31.

The fixing device 50 allows the sheet P to pass through, for example, a fixing nip portion R3 for heating and pressing the sheet so that the toner image secondarily transferred from the transfer belt 31 to the sheet P is adhered and fixed to the sheet P. The fixing device 50 may include a heating roller 52 which heats the sheet P and a pressing roller 54 which presses and rotates the heating roller 52. Each of the heating roller 52 and the pressing roller 54 may be formed in a cylindrical shape and the heating roller 52 includes a heat source such as a halogen lamp. The fixing nip portion R3 which is a contact region is provided between the heating roller 52 and the pressing roller 54 and the toner image is heated and fixed (e.g., fused) to the sheet P when the sheet P passes through the fixing nip portion R3.

The discharging device 60 includes, for example, discharging rollers 62 and 64 which discharge the sheet P having the toner image fixed thereto by the fixing device 50 to the outside of the apparatus.

An example printing process is now described with reference to the imaging apparatus 1 illustrated in FIG. 1. When an image signal of a recording target image is input to the imaging apparatus 1, the controller 80 of the imaging apparatus 1 rotates the feeding roller 11 so that the sheet P stacked in the cassette K is picked up and conveyed. Then, the surface of the image carrier 40 is uniformly charged to a predetermined potential by the charging roller 41 (a charging operation). Then, a laser beam is irradiated to the surface of the image carrier 40 by the exposure unit 42 on the basis of the received image signal to form an electrostatic latent image (an exposing operation).

In the developing device 20, the electrostatic latent image is developed and a toner image is formed (a developing operation). The toner image which is formed in this way is initially transferred from the image carrier 40 to the transfer belt 31 in a region in which the image carrier 40 and the transfer belt 31 face each other (a transferring operation). The toner images formed on four image carriers 40 are sequentially superimposed on the transfer belt 31 so that one composite toner image is formed. Then, the composite toner image is secondarily transferred to the sheet P conveyed from the conveying device 10 in the transfer nip portion R2 in which the suspension roller 37 and the secondary transfer roller 33 face each other.

The sheet P to which the composite toner image is secondarily transferred is conveyed to the fixing device 50. Then, the fixing device 50 fuses or otherwise fixes the composite toner image to the sheet P such as by heating and pressing the sheet P between the heating roller 52 and the pressing roller 54 when the sheet P passes through the fixing nip portion R3 (a fixing operation). Next, the sheet P is discharged to the outside of the imaging apparatus 1 by the discharging rollers 62 and 64.

An example bias control in each mode during the printing job (a control of the bias application unit 70 by the controller 80) will now be described with further reference to the imaging apparatus 1. The controller 80 may comprise an electronic control unit (e.g., a control device or a computer) which controls the bias application unit 70 so that a plurality of continuous or sequential operations are performed during the printing job. As illustrated in FIG. 1, the controller 80 is communicatively coupled to at least the bias application unit 70, the feeding roller 11, and a temperature/humidity sensor 110 via an electric communication line to communicate with them. The controller 80 performs a bias control process (which will be described later in further detail) by reading and executing a bias control program, provided in the form of processor-readable data and instructions 85 stored in a memory 84 which is a computer readable memory. The controller 80 may be configured as a single electronic control device or a plurality of electronic control devices.

The imaging apparatus 1 may include a normal mode and an image adjustment mode during the printing job. In the normal mode, a toner image is carried on the image carrier 40 and the toner image is transferred to the sheet P. Additionally, the controller 80 controls the bias application unit 70 so that a first bias is applied to the secondary transfer roller 33 and the toner image is transferred to the sheet P. The first bias is set to a bias having a polarity opposite to a main polarity of the toner. In some examples, both positively charged toner and negatively charged toner are included in the toner, but either positive or negative polarity is predominantly (mostly) included therein. The "main polarity of the toner" indicates the polarity predominantly (mostly) included in the toner. In the normal mode, for example, when the main polarity of the toner is negative, the bias application unit 70 applies a first bias having a positive polarity opposite to the main polarity of the toner to the secondary transfer roller 33. Accordingly, the toner image which is initially transferred from the image carrier 40 to the transfer belt 31 in the transfer nip portion R2 is secondarily transferred to the sheet P.

In the image adjustment mode, an image is adjusted by carrying an image adjustment pattern AP (an adjustment toner image) for adjusting an image on the image carrier 40.

Figure 2:
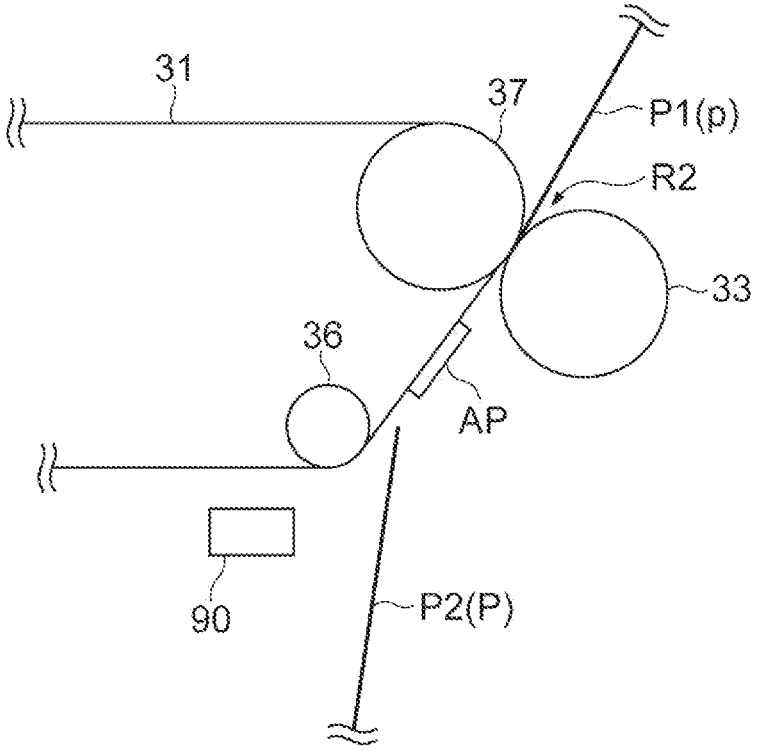
FIG. 2 is a schematic diagram illustrating a part of an example transfer device.

The image adjustment mode is performed when the sheet P does not pass through the transfer nip portion R2 in a continuous running state in which the toner image is continuously transferred to the plurality of sheets P (recording media). As illustrated in FIG. 2, in the image adjustment mode, the image adjustment pattern AP passes through the transfer nip portion R2 between a sheet P1 (a first medium) and a sheet P2 (a second medium) following the sheet P1 in a continuous running state.

In the image adjustment mode, a plurality of image adjustment patterns AP (adjustment toner images) are carried on the image carrier 40. For example, the plurality of image adjustment patterns AP are carried on the image carrier 40 to be located at both end portions and the center portion in the axial direction while being separated in the axial direction (the longitudinal direction) of the image carrier 40. The image adjustment patterns AP carried on the image carrier 40 are initially transferred to the transfer belt 31 and are detected by image adjustment sensors 90 (see FIG. 2) disposed in the vicinity of the transfer belt 31. Then, an image adjustment such as color registration adjustment and density adjustment is performed on the basis of the detection result of the image adjustment sensors 90.

Since the sheet P does not pass through the transfer nip portion R2 in the image adjustment mode, the image adjustment patterns AP reaching the transfer nip portion R2 come into contact with the secondary transfer roller 33. Therefore, the controller 80 controls the bias application unit 70 so that a second bias having a polarity opposite to the first bias is applied to the secondary transfer roller 33. Accordingly, the image adjustment pattern AP initially transferred from the image carrier 40 to the transfer belt 31 at the transfer nip portion R2 may be prevented from being transferred to the secondary transfer roller 33. The controller 80 controls the bias application unit 70 so that an opposite bias (the second bias) is applied to the secondary transfer roller 33 while at least the image adjustment pattern AP passes through the transfer nip portion R2.

Figure 4:
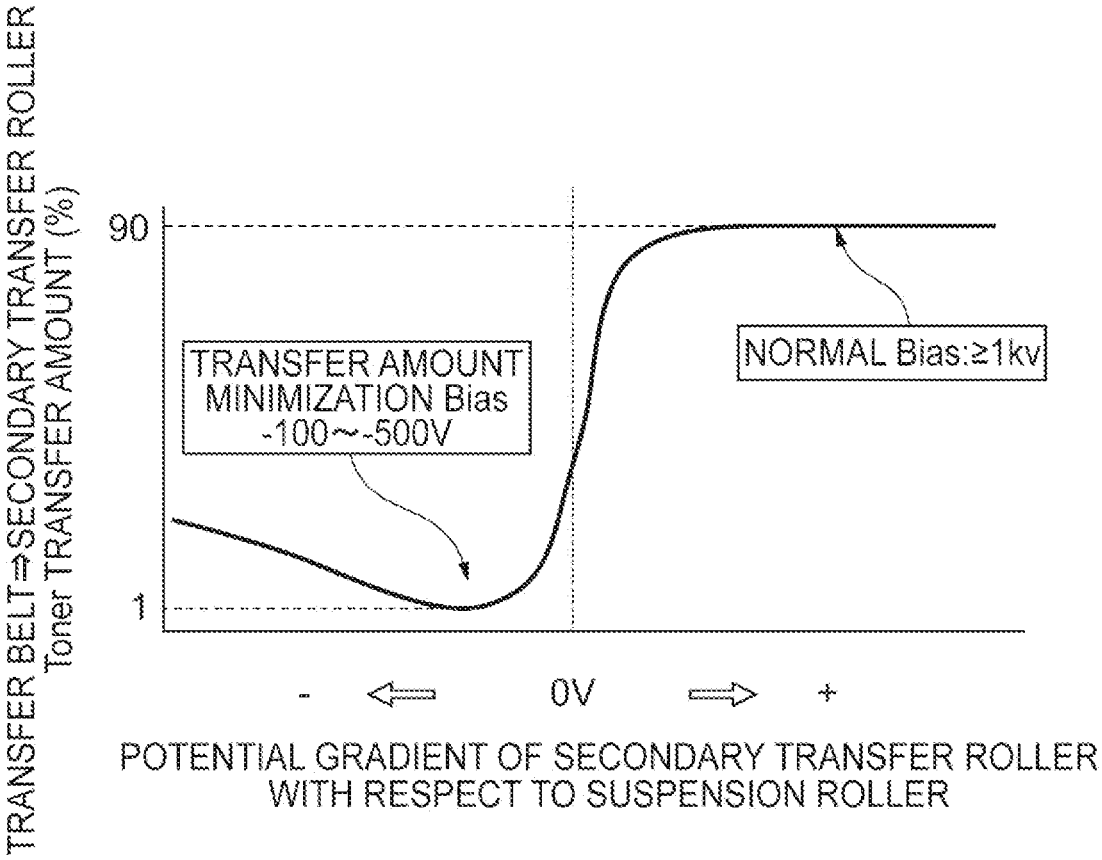
FIG. 4 is a graph illustrating an example relationship between a toner transfer amount from a transfer belt to a secondary transfer roller and a potential gradient of the secondary transfer roller with respect to a suspension roller in the case of a second bias.
Figure 5:
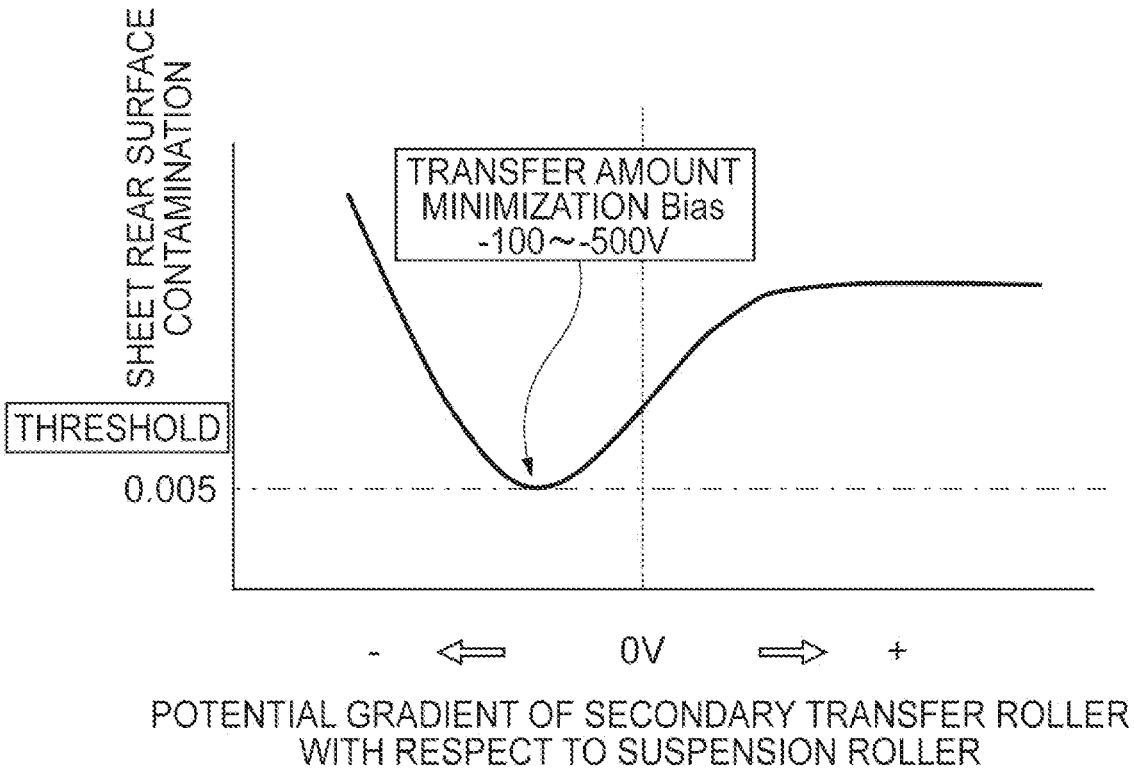
FIG. 5 is a graph illustrating an example relationship between sheet rear surface contamination and a potential gradient of the secondary transfer roller with respect to the suspension roller in the case of the second bias.

FIG. 4 is a measurement result of an example relationship between a toner transfer amount from the transfer belt 31 to the secondary transfer roller 33 and a potential gradient of the secondary transfer roller 33 with respect to the suspension roller 37 in the case of the second bias in the image adjustment mode. FIG. 5 is a measurement result of an example relationship between a rear surface contamination of the sheet P and a potential gradient of the secondary transfer roller 33 with respect to the suspension roller 37 in the case of the second bias in the image adjustment mode. The measurement result illustrated in FIG. 5 is obtained by measuring the image density of the rear surface of the sheet P passing through the transfer nip portion R2 as the rear surface contamination after the end of the image adjustment mode by using a commercial densitometer. Then, the image density of 0.005 is set as a threshold value of the rear surface contamination from the result of the sensory evaluation.

As illustrated in FIGS. 4 and 5, in the image adjustment mode, the toner transfer amount decreases when the opposite bias (the second bias) is applied to the secondary transfer roller 33 and the toner transfer amount substantially decreases when the applied opposite bias exceeds −100 [V]. However, when the opposite bias exceeds −500 [V], the toner transfer amount increases due to the reverse polarity or the reverse charge caused by the influence of the separation discharge and hence the toner transfer amount increases. Furthermore, even when the toner is positively charged (when the main polarity of the toner is positive), the result is substantially the same as above.

In the image adjustment mode, the absolute value of the opposite bias (the second bias) applied from the bias application unit 70 to the secondary transfer roller 33 may be 500 [V] or less and in some examples is 100 [V] or more. The controller 80 may be configured to determine the value of the second bias so that a potential difference between the suspension roller 37 and the secondary transfer roller 33 to which the second bias is applied fall in the range of 0 to 500 V (or, in the range of 100 to 500 V). In some examples, the controller 80 sets the absolute value of the transfer bias (the first bias) to about 1.2 [KV] in the normal mode and sets the absolute value of the opposite bias (the second bias) in the image adjustment mode to about 200 [V]. Furthermore, the absolute value of the transfer bias applied from the bias application unit 70 to the secondary transfer roller 33 in the normal mode may be about 1.0 to 1.2 [KV]. Therefore, the absolute value of the opposite bias applied from the bias application unit 70 to the secondary transfer roller 33 in the image adjustment mode may be ½ or less of the absolute value of the transfer bias applied from the bias application unit 70 to the secondary transfer roller 33 in the normal mode.

Further, the controller 80 may acquire information relating to the toner density of the image adjustment pattern AP (the adjustment toner image) and compare the toner density with a predetermined value. When the toner density is greater than the predetermined value, the bias application unit 70 may be controlled so that a third bias having the same polarity as the first bias is applied to the secondary transfer roller 33 after the second bias. The predetermined value may be set to, for example, 0.3 $mg/cm^2$ or a value greater than 0.3 $mg/cm^2$. The controller 80 acquires information relating to the toner density of the image adjustment pattern AP (the adjustment toner image) in advance before the start of the printing job. Since the information relating to the toner density of the image adjustment pattern AP is determined before the start of the printing job, the controller 80 can acquire information relating to the toner density of the image adjustment pattern AP to be processed before the start of the printing job.

The controller 80 controls the feeding roller 11 of the conveying device 10 so that a distance between the sheet P1 and the sheet P2 (see FIG. 2) becomes an extension distance which is larger than a reference page gap (a normal distance) corresponding to a distance in a normal state. The extension distance may exceed the reference page gap by a predetermined extension amount when the toner density is greater than the predetermined value. The controller 80 may then control the bias application unit 70 so that the second bias is applied to the secondary transfer roller 33 during a reference period corresponding to a reference page gap (an area corresponding to the reference page gap passes through the transfer nip portion R2) and the third bias is applied to the secondary transfer roller 33 during an extension period corresponding to the extension amount (an area corresponding to the extension amount passes through the transfer nip portion R2). In some examples, the controller 80 may determine the value (the length) of the extension amount in response to the toner density. For example, the controller 80 may increase the third bias application time by increasing the extension amount as the toner density increases. The controller 80 may control the bias application unit 70 so that the third bias is applied during a period in which at least the secondary transfer roller 33 rotates by one revolution.

Further, the controller 80 may determine whether to set the distance between the sheet P1 and the sheet P2 as the extension distance in consideration of at least one of the temperature and the humidity detected by the temperature/humidity sensor 110 (e.g., the first sensor, see FIG. 1) configured to detect at least one of the temperature and the humidity. The controller 80 can readily set the distance between the sheet P1 and the sheet P2 as the extension distance, for example, as the temperature and/or the humidity increases. Further, the controller 80 may acquire the state (for example, gloss, quality, or the like) of the sheet P used in the printing job and may determine at least one of the values of the extension amount and the third bias in consideration of the state. The controller 80 may increase the value of the extension amount and/or the value of the third bias, for example, in the case of coated sheet or the like of which the contamination is conspicuous. Accordingly, by increasing the extension amount to increase the third bias application time and the value of the third bias at the time of using the sheet P of which the contamination of the toner image is conspicuous, the visual indication of the contamination may be reduced.

Figure 6:
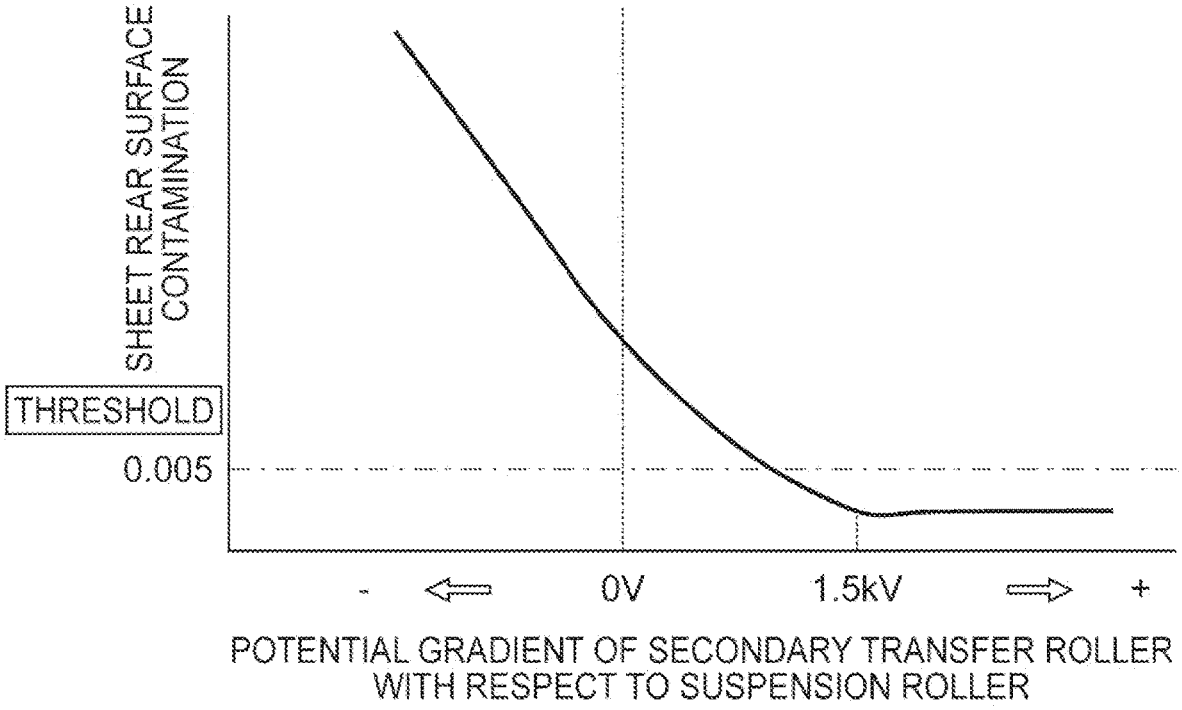
FIG. 6 is a graph illustrating an example relationship between sheet rear surface contamination and a potential gradient of the secondary transfer roller with respect to the suspension roller in the case of a third bias.

FIG. 6 is a measurement result of a relationship between the rear surface contamination of the sheet P and the potential gradient of the secondary transfer roller 33 with respect to the suspension roller 37 in the case of the third bias in the image adjustment mode. The measurement result illustrated in FIG. 6 was obtained by measuring the image density of the rear surface of the sheet P passing through the transfer nip portion R2 as the rear surface contamination after the end of the image adjustment mode by using a commercial densitometer. The image density of 0.005 was set as a threshold value of the rear surface contamination from the result of the sensory evaluation.

As illustrated in FIG. 6, in the image adjustment mode, when the third bias having the same polarity as the first bias is applied to the secondary transfer roller 33 after applying the opposite bias (the second bias) thereto, the toner contamination adhering to the sheet P can be decreased. As described above, the toner having a main polarity may be prevented from being transferred to the secondary transfer roller 33 by applying the second bias. However, although the amount may not be large, the toner having a minus polarity may be readily transferred to the secondary transfer roller 33 by the application of the second bias. Regarding this point, when the third bias having the same polarity as the first bias (the bias having the same polarity as the toner of the minus polarity transferred to the secondary transfer roller 33) is applied, the toner transferred to the secondary transfer roller 33 is returned to the transfer belt 31 so that the toner contamination of the rear surface of the sheet P can be decreased. For example, the controller 80 sets the absolute value of the transfer bias (the first bias) to about 1.2 [KV] and sets the absolute value of the third bias to 1.5 [KV] or more in the normal mode. In some examples, the controller 80 determines the value of the third bias so that a potential difference between the suspension roller 37 and the secondary transfer roller 33 to which the third bias is applied becomes 1.5 [KV] or more. Accordingly, the visual indication of the contamination of the rear surface of the sheet P is minimized, reduced, or eliminated.

Figure 3:
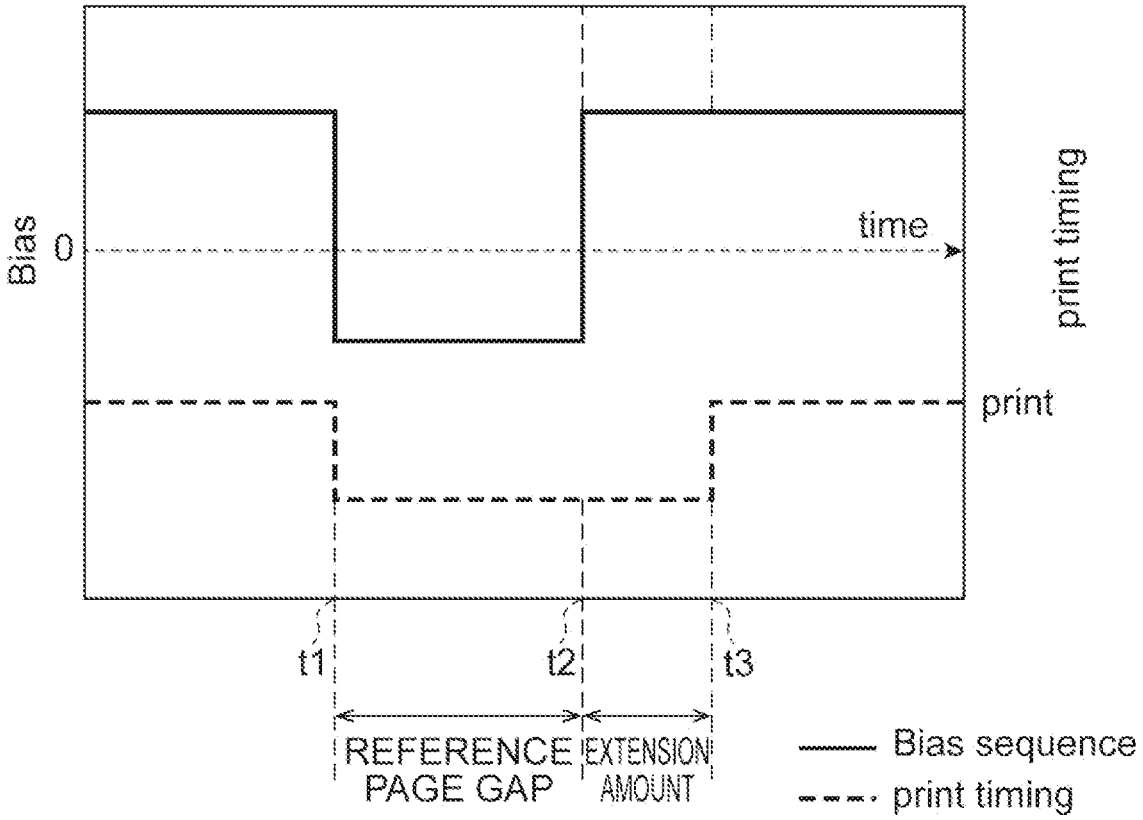
FIG. 3 is a sequence diagram illustrating an example bias control.

FIG. 3 is a sequence diagram illustrating the bias control at the time of applying the third bias. In FIG. 3, a horizontal axis indicates time and a vertical axis indicates the bias applied to the secondary transfer roller 33. In FIG. 3, the period from time zero to time t1 is an initial period in which the toner image is transferred to the sheet P1, the period from the time t1 to time t2 is a reference period corresponding to a reference page gap, the period from the time t2 to time t3 is an extension period corresponding to the extension amount, and the period after the time t3 is a secondary transfer period in which the toner image is transferred to the sheet P2 following the sheet P1. During the initial period and/or the secondary transfer period, a process of the normal mode may be performed, and during the reference period and the extension period a process of the image adjustment mode may be performed. In the initial period to the time t1 at the time of performing the process of the normal mode, the first bias is applied to the secondary transfer roller 33. Next, the second bias having a polarity opposite to the first bias is applied to the secondary transfer roller 33 during the reference period from the time t1 to t2. Next, the third bias having the same polarity as the first bias is applied to the secondary transfer roller during the extension period from the time t2 to t3. Then, the process of the normal mode is performed again after the time t3 so that the first bias is applied to the secondary transfer roller 33.

Figure 7:
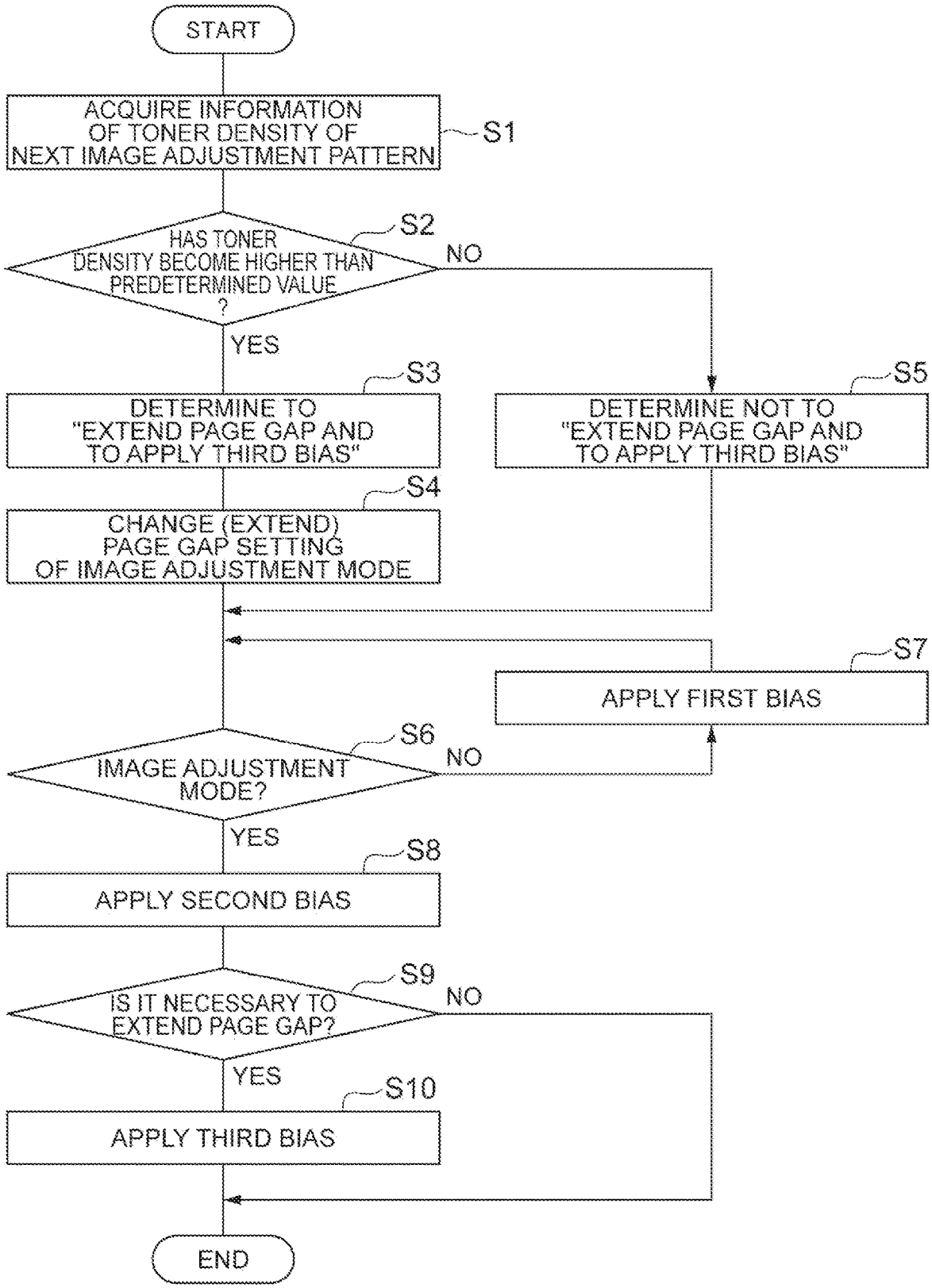
FIG. 7 is a flowchart illustrating an example bias control.

An example bias control process which may be performed by the controller 80 is now described with reference to FIG. 7, with further reference to FIGS. 1 and 2. For example, the process operation of the controller 80 is performed by reading and executing the processor-readable data and instructions of the bias control program 85 stored in the memory 84.

At operation S1, the controller 80 acquires information relating to the toner density of the image adjustment pattern AP of the image adjustment mode to be performed next before the printing job starts. The controller 80 acquires the toner density of the image adjustment pattern AP by referring to, for example, the memory 84. At operation S2, the controller 80 determines whether the acquired toner density is greater than a predetermined value (for example, 0.3 $mg/cm^2$).

When it is determined that the toner density is greater than the predetermined value in operation S2, the controller 80 determines to extend a page gap corresponding to a distance between the sheet P1 and the sheet P2 (see FIG. 2) by a predetermined extension amount and to apply the third bias to the secondary transfer roller 33 during the extension period corresponding to the extension amount (operation S3). At operation S4, the controller 80 controls the feeding roller 11 of the conveying device 10 so as to change (extend) the setting of the page gap in the image adjustment mode. On the other hand, when it is determined that the toner density is not greater than the predetermined value in operation S2, the controller 80 determines not to extend the page gap and to apply the third bias (operation S5).

At operation S6, the controller 80 determines whether the current mode is the image adjustment mode. When it is determined that the current mode is not the image adjustment mode (the current mode is the normal mode) in operation S6, the controller 80 controls the bias application unit 70 so that the first bias is applied to the secondary transfer roller 33 and the toner image is transferred to the sheet P (operation S7). The first bias is set to a bias having a polarity opposite to the main polarity of the toner. In some example, operation S6 is performed again after a predetermined time elapses.

On the other hand, when it is determined that the current mode is the image adjustment mode in operation S6, the controller 80 first controls the bias application unit 70 so that the second bias having a polarity opposite to the first bias is applied to the secondary transfer roller 33 (operation S8). The controller 80 controls the bias application unit 70 so that the second bias is applied to the secondary transfer roller 33, for example, during a reference period corresponding to a reference page gap.

At operation S9, the controller 80 determines whether to extend the page gap as a determination result of operation S2. When the page gap is not extended, the process of the image adjustment mode ends after the application of the second bias. On the other hand, when the page gap is extended, the controller 80 controls the bias application unit 70 so that the third bias having the same polarity as the first bias is applied to the secondary transfer roller 33 after the application of the second bias. For example, the controller 80 controls the bias application unit 70 so that the third bias is applied to the secondary transfer roller 33 during the extension period corresponding to the extension amount. In some examples, the process of the image adjustment mode ends after the application of the third bias.

In some examples, the controller 80 controls the bias application unit 70 to perform an operation of applying the first bias to the secondary transfer roller 33 so that the toner image is transferred onto the sheet P1 during the printing job. Additionally, the controller 80 may be configured to control the bias application unit 70 to perform an operation of applying the second bias having a polarity opposite to the first bias to the secondary transfer roller 33 between the sheet P1 and the sheet P2 following the sheet P1 during the printing job. Still further, the controller 80 may be configured to control the bias application unit 70 to perform an operation of applying the third bias having the same polarity as the first bias to the secondary transfer roller 33 after the application of the second bias. Since the second bias having a polarity opposite to the first bias is applied to the secondary transfer roller 33 in the page gap between the sheet P1 and the sheet P2, toner may be prevented from being transferred to the secondary transfer roller 33. Although the polarity of the toner may be generally biased to one of positive and negative, at least a part of the toner (e.g., the toner having a minus polarity) may have a polarity opposite to the main polarity. For this reason, since the second bias is applied to the secondary transfer roller 33, the toner having a minus polarity may be transferred to the secondary transfer roller 33 and then may adhere to the sheet P2 or the like passing through the transfer nip portion R2 so that toner contamination occurs. Regarding this point, since the third bias having the same polarity as the first bias is applied to the secondary transfer roller 33 after the application of the second bias in the page gap between the sheet P1 and the sheet P2, the toner transferred to the secondary transfer roller 33 can be returned to the transfer belt 31 to prevent the toner contamination from adhering to the rear surface of the sheet P. Accordingly, the processor-readable data and instructions 85 stored in the memory 84 may be executed by the controller 80 to control the bias application device (or bias application unit) 70. The controller 80 may control the bias application device 70 to apply the first bias to the transfer roller 33 at S7 so that the toner image is transferred to the sheet P1, for example when the sheet P1 is located at the transfer nip region R2. The controller 80 may control the bias application device 70 to apply the second bias to the transfer roller 33 at S8, in the page gap between the sheet P1 and the sheet P2, for example when the image adjustment pattern AP is located at the transfer nip region R2. The controller 80 may control the bias application device 70 to apply the third bias to the transfer roller 33 at S10 in the page gap between the sheet P1 and the sheet P2, for example after the image adjustment pattern AP has been carried through the transfer nip region.

Figure 8:
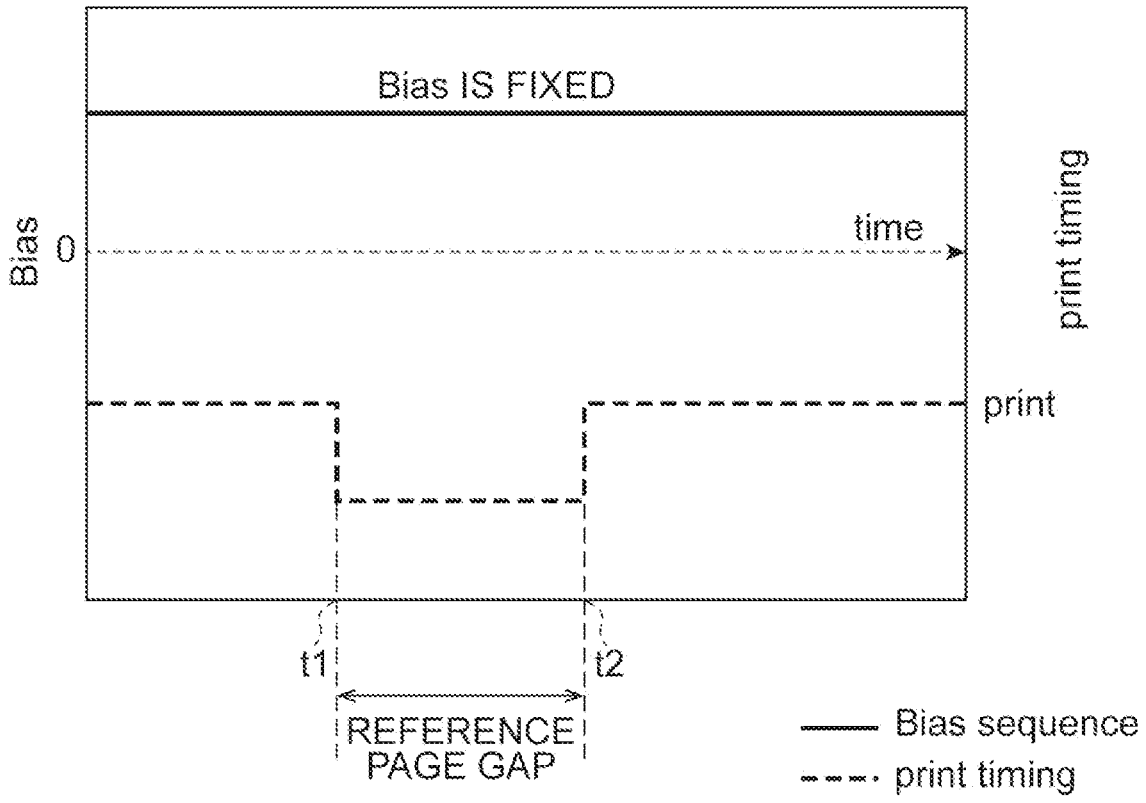
FIG. 8 is a sequence diagram illustrating a bias control according to a comparative example.
Figure 10:
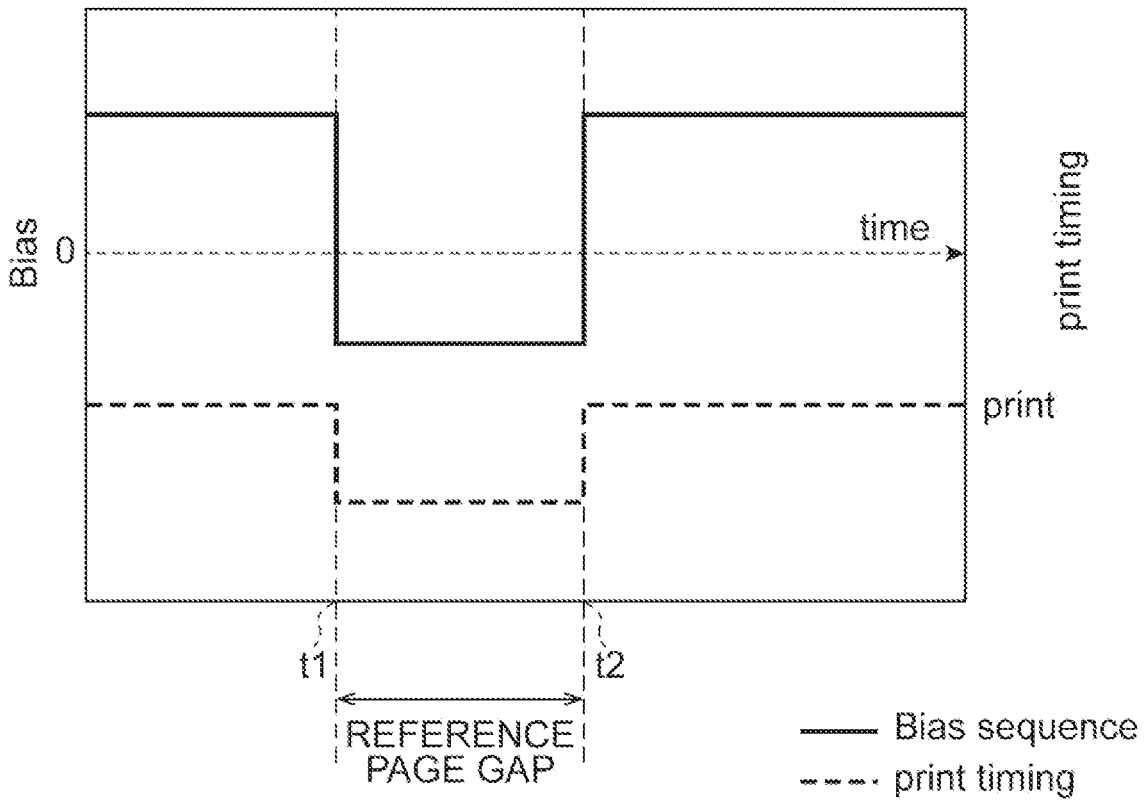
FIG. 10 is a sequence diagram illustrating a bias control according to a comparative example.

The measurement result of the toner contamination of the sheet P during such a control is now described with reference to FIGS. 3 and 8 and FIGS. 10 to 12. FIG. 8 includes a sequence diagram illustrating a bias control according to a comparative example and further includes a sequence diagram illustrating an example in which the bias is constantly set to the first bias during the printing job. FIG. 9 is a table illustrating the measurement result of the toner contamination of the sheet P during the bias control illustrated in FIG. 8. FIG. 10 includes a sequence diagram illustrating a bias control according to a comparative example and further includes a sequence diagram illustrating an example in which the first bias is applied in the normal mode and the second bias is applied in the image adjustment mode during the printing job. FIG. 11 is a table illustrating the measurement result of the toner contamination of the sheet P during the bias control illustrated in FIG. 10. FIG. 3 includes a sequence diagram illustrating an example bias control and further includes a sequence diagram of an example in which the first bias is applied in the normal mode, the second bias is applied during the reference period in the image adjustment mode, and the third bias is applied during the extension period in the image adjustment mode during the printing job. FIG. 12 is a table illustrating the measurement result of the toner contamination of the sheet P during the bias control illustrated in FIG. 3. In FIGS. 8, 10, and 3, the period from the time t1 to time t2 indicates the reference period in which the image adjustment mode is performed. FIGS. 9 to 12 show the measurement results under different temperatures and humidity (30° 85% RH, 22° 55% RH, and 10° 10% RH) for each of two different sheet types (plain sheet and double coated sheet). The measurement result indicates the toner contamination density [mg/cm$^2$] of the rear surface of the sheet P.

As illustrated in FIGS. 9 to 12, in a configuration in which the third bias is applied after the application of the second bias in the image adjustment mode under any temperature and humidity environment of each sheet (a configuration in which the example bias control illustrated in FIG. 3 is performed), the toner contamination of the sheet P can be substantially prevented.

Further, the controller 80 acquires information relating to the toner density of the toner image and compares the toner density with a predetermined value. When the toner density is greater than the predetermined value, the bias application unit 70 is controlled so that the third bias is applied after the second bias. In some examples, since the third bias application process is performed when the toner density is greater than a predetermined value, that is, when the toner contamination readily occurs, a control which does not include the third bias application process may be performed. For example, when the toner density is low and the toner contamination does not occur even when the third bias application process is not performed, the toner contamination which cannot be visually confirmed occurs. Accordingly, the efficiency of the process of transferring the toner image to the sheet P may be maintained during the printing job.

The imaging apparatus 1 may include the conveying device 10 which conveys the sheet P to the transfer nip portion R2 and the controller 80 may be configured to control the feeding roller 11 of the conveying device 10 so that a distance between the sheet P1 and the sheet P2 following the sheet P1 becomes an extension distance extended from a normal distance corresponding to a distance in a normal state by a predetermined extension amount when the toner density is greater than a predetermined value. In some examples, by applying the third bias and by extending the page gap when the toner density is greater than a predetermined value, that is, the toner contamination readily occurs and the page gap distance is not changed when the toner density is low, the efficiency of the process of transferring the toner image to the sheet P may be maintained during the printing job.

Further, since the controller 80 determines the extension amount in response to the toner density, the extension amount and the third bias application time may be increased, for example, as the toner density increases. As a result, a flexible cleaning process may be performed in response to the toner density.

The controller 80 controls the bias application unit 70 so that the second bias is applied to the secondary transfer roller 33 during the reference period corresponding to the normal distance and the third bias is applied to the secondary transfer roller 33 during the extension period corresponding to the extension amount. Accordingly, since the page gap may be extended in response to the third bias application time in a case in which the third bias is applied, the control can be readily and reliably performed.

The imaging apparatus 1 may further include the temperature/humidity sensor 110 capable of detecting at least one of the temperature and the humidity and the controller 80 may be configured to determine whether to set a distance between the sheet P1 and the sheet P2 as the extension distance in consideration of at least one of the temperature and the humidity detected by the temperature/humidity sensor 110. As illustrated in FIGS. 9 to 12, the toner contamination of the sheet P generally increases as the temperature and the humidity increase. Accordingly, the controller 80 can perform a cleaning process by performing a control of determining to extend the page gap distance, for example, as the temperature and the humidity increase.

Further, the controller 80 may be configured to acquire the state of the sheet P and to determine at least one of the extension amount and the third bias in consideration of the state. As illustrated in FIGS. 9 to 12, for example, the coated sheet may have a toner contamination that is more conspicuous than a plain sheet. Accordingly, the controller 80 can perform a cleaning process by acquiring the state (for example, gloss, quality, or the like) of the sheet P and determining to increase the extension amount and the third bias in the case of the coated sheet.

Additionally, the controller 80 may be configured to acquire information relating to the toner density in a section between the sheet P1 and the sheet P2 in advance before the printing job starts. For example, in the method of acquiring the toner density on the basis of the measurement value of the image adjustment sensor 90, a process of extending the page gap distance in a short time may be performed after acquiring the toner density. As a result, the distance between the sheets P1 and P2 may be extended less than an expected amount (e.g., the process is slow). Regarding this point, since the image adjustment pattern AP of the image adjustment mode to be performed next before the start of the printing job is determined in advance, the toner density of the image adjustment pattern AP may be acquired before the printing job starts. Then, since the toner density is acquired in advance, the page gap distance may be extended at a predetermined or particular timing by determining whether to extend the page gap distance and to apply the third bias in advance. Accordingly, the distance between the sheets P1 and P2 may be consistently extended by an expected amount.

The predetermined value of the toner density may be a value greater than 0.3 $mg/cm^2$. Accordingly, since the third bias may be applied when the toner contamination of the sheet P occurs, the cleaning process may be performed.

The suspension roller 37 may be disposed to face the secondary transfer roller 33 while pressing the secondary transfer roller 33 and to sandwich the transfer belt 31 along with the secondary transfer roller 33. Additionally, the controller 80 may be configured to determine the value of the second bias so that a potential difference between the suspension roller 37 and the secondary transfer roller 33 to which the second bias is applied falls in the range of 0 to 500 V. Accordingly, as illustrated in FIGS. 4 and 5, the toner contamination of the sheet P can be prevented.

In some examples, the controller 80 determines the value of the third bias so that a potential difference between the suspension roller 37 and the secondary transfer roller 33 to which the third bias is applied becomes 1.5 KV or more. Accordingly, as illustrated in FIG. 6, the toner contamination of the sheet P can be prevented.

Still further, the controller 80 may be configured to control the bias application unit 70 so that the second bias and the third bias are applied in the image adjustment mode in which an image is adjusted by carrying the image adjustment pattern AP for adjusting an image on the transfer belt 31. Since the sheet P does not pass through the transfer nip portion R2 in the image adjustment mode, the toner of the image adjustment pattern AP may be readily transferred to the secondary transfer roller 33. Regarding this point, since the second bias is applied to prevent the toner from being transferred to the secondary transfer roller 33 and the third bias is applied to return the toner transferred to the secondary transfer roller 33 to the transfer belt 31 in the image adjustment mode, toner contamination of the sheet P may be prevented.

As the controller 80 may be configured to control the bias application unit 70 so that the third bias is applied during a period in which at least the secondary transfer roller 33 rotates by one revolution, the transferred toner can be uniformly returned to the transfer belt 31 at the secondary transfer roller 33.

It is to be understood that not all aspects, advantages and features described herein may necessarily be achieved by, or included in, any one particular example. Indeed, having described and illustrated various examples herein, it should be apparent that other examples may be modified in arrangement and detail.

Figure 13:
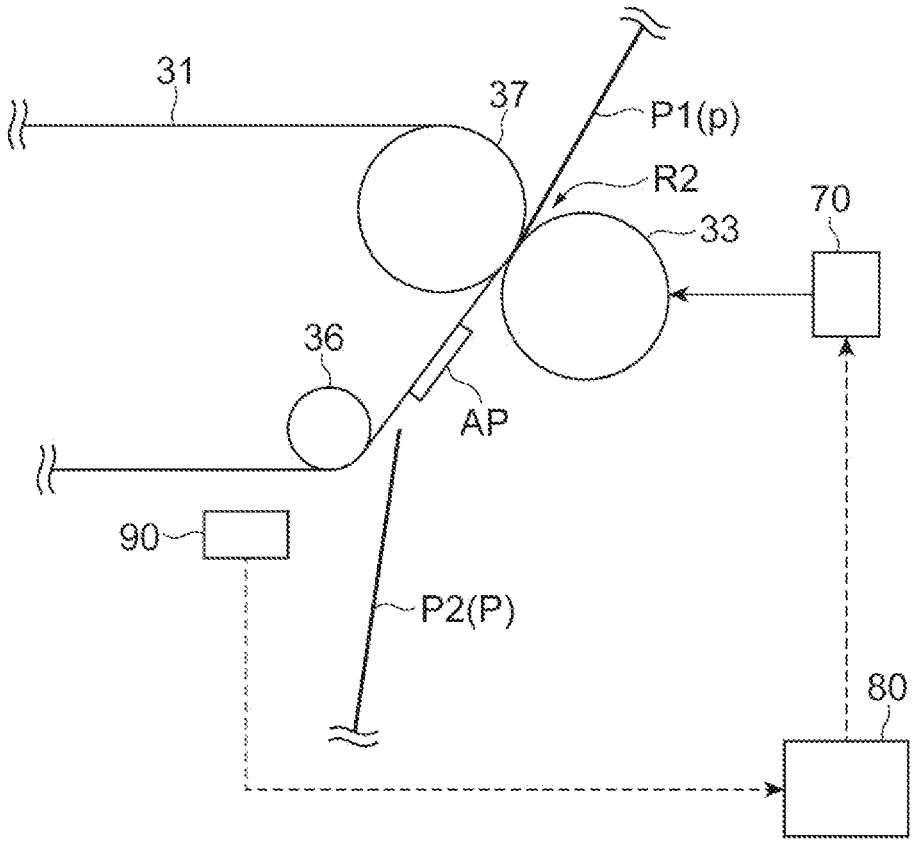
FIG. 13 is a schematic diagram illustrating a part of an example imaging apparatus.

One or more examples have been described in which the controller 80 acquires information relating to the toner density in the section between the sheet P1 and the sheet P2 in advance before the printing job starts. However in the example illustrated in FIG. 13, the controller 80 may acquire a measurement value of the toner density of the image adjustment pattern AP in a section between the sheet P1 and the sheet P2 from the image adjustment sensor 90. The controller 80 may control the bias application unit 70 by determining whether to apply the third bias on the basis of the acquired measurement value of the toner density. In some examples, the toner density may be acquired on the basis of the real-time information by acquiring the measurement value. Furthermore, when the measurement value is acquired, examples have been described in which the page gap distance between the sheets P1 and P2 in a conveyed state cannot be readily extended (e.g., the process is slow). However, when the page gap distance between the sheet P1 and the sheet P2 is originally a distance in which the second bias and the third bias can be applied, the third bias may be applied without extending the page gap distance. That is, in an example configuration in which the measurement value of the toner density is acquired, the toner density contamination of the sheet P may be prevented, for example, when the third bias can be applied without extending the page gap distance.

The invention claimed is:

1. An imaging system comprising:

a transfer roller forming a transfer nip region between the transfer roller and a transfer belt, the transfer roller to transfer toner images carried on the transfer belt, onto media conveyed through the transfer nip region, during a printing job;

a bias application device to apply a bias to the transfer roller; and a controller to control the bias application device so that a plurality of operations are performed during the printing job, wherein the operations comprise:

applying a first bias to the transfer roller so that a first toner image is transferred to a first medium during the printing job, applying a second bias having a polarity opposite to the first bias to the transfer roller between the first medium and a second medium following the first medium during the printing job, applying a third bias having the same polarity as the first bias to the transfer roller between the first medium and the second medium during the printing job, and applying the third bias after the second bias when a toner density of a second toner image carried on the transfer belt is greater than a predetermined level.

2. The imaging system according to claim 1, the controller to acquire information relating to the toner density of the second toner image carried on the transfer belt and to compare the toner density with the predetermined value, and the controller to control the bias application device so that the third bias is applied after the second bias when the toner density is greater than the predetermined value.

3. The imaging system according to claim 2, comprising:

a conveying device to convey the media to the transfer nip region, the controller to control the conveying device so that an extension distance between the first medium and the second medium exceeds a normal distance between the first medium and the second medium by a predetermined extension amount when the toner density is greater than the predetermined value.

4. The imaging system according to claim 3, the controller to determine the extension amount in response to the toner density.

5. The imaging system according to claim 3, the controller to control the bias application device so that the second bias is applied to the transfer roller during a reference period corresponding to the normal distance and the third bias is applied to the transfer roller during an extension period corresponding to the extension amount.

6. The imaging system according to claim 3, comprising:

a sensor to detect at least one of a temperature and a humidity, the controller to determine whether to set a distance between the first medium and the second medium as the extension distance in consideration of at least one of the temperature and the humidity detected by the sensor.

7. The imaging system according to claim 3, the controller to acquire a medium state and determines at least one of a value of the extension amount and a value of the third bias in consideration of the medium state.

8. The imaging system according to claim 2, the controller to acquire the information relating to the toner density in a section between the first medium and the second medium in advance before the printing job starts.

9. The imaging system according to claim 2, comprising:

a sensor to detect the toner density of the second toner image, the controller to acquire the toner density in a section between the first medium and the second medium from the sensor.

10. The imaging system according to claim 2, wherein the predetermined value of the toner density is greater than 0.3 mg/cm2.

11. The imaging system according to claim 1, comprising:

a suspension roller disposed to face the transfer roller while pressing against the transfer roller, to sandwich the transfer belt against the transfer roller, the controller to determine the value of the second bias so that a potential difference between the suspension roller and the transfer roller to which the second bias is applied falls in the range of 0 to 500 V.

12. The imaging system according to claim 11, the controller to determine the value of the third bias so that a potential difference between the suspension roller and the transfer roller to which the third bias is applied becomes 1.5 KV or more.

13. An imaging system comprising:

a transfer roller forming a transfer nip region between the transfer roller and a transfer belt, the transfer roller to transfer toner images carried on the transfer belt, onto media conveyed through the transfer nip region, during a printing job;

a bias application device to apply a bias to the transfer roller; and a controller to control the bias application device so that a plurality of operations are performed during the printing job, wherein the operations comprise:

applying a first bias to the transfer roller so that a first toner image is transferred to a first medium during the printing job, applying a second bias having a polarity opposite to the first bias to the transfer roller between the first medium and a second medium following the first medium during the printing job, and applying a third bias having the same polarity as the first bias to the transfer roller between the first medium and the second medium during the printing job, the controller to control the bias application device so that the third bias is applied during a period in which at least the transfer roller rotates by one revolution.

14. A storage device for an imaging system that includes a transfer belt to carry toner images, a transfer roller to transfer the toner images from the transfer belt onto media, and a bias application device to apply a bias to the transfer roller, wherein the storage device comprises processor-readable data and instructions to control the bias application device to:

apply a first bias to the transfer roller so that a first toner image is transferred to a first medium of a printing job, apply a second bias having a polarity opposite to the first bias to the transfer roller between the first medium and a second medium following the first medium, during the printing job, apply a third bias having the same polarity as the first bias to the transfer roller, between the first medium and the second medium during the printing job, and apply the third bias after the second bias when a toner density of a second toner image carried on the transfer belt is greater than a predetermined level.

15. The storage device according to claim 14, the processor-readable data and instructions to control the bias application device to:

apply the first bias when the first toner image and the first medium are located at a transfer nip region between the transfer roller and the transfer belt, apply the second bias when a second toner image carried on the transfer belt is located at the transfer nip region, and apply the third bias after the second toner image has been carried through the transfer nip region.

* * * * *